United States Patent [19]

Oehlert

[11] Patent Number: 4,522,007

[45] Date of Patent: Jun. 11, 1985

[54] INTERLOCKING BUILDING PANEL

[76] Inventor: James A. Oehlert, R.R. 3, Box 396-F, Longview, Tex. 75603

[21] Appl. No.: 552,611

[22] Filed: Nov. 17, 1983

[51] Int. Cl.[3] ..... E04C 1/10; E04C 1/30; E04D 3/362

[52] U.S. Cl. ..... 52/588; 52/521; 52/522; 52/536; 52/542

[58] Field of Search ..... 52/588, 506, 542, 536, 52/522, 521, 478

[56] References Cited

U.S. PATENT DOCUMENTS

| | | | |
|---|---|---|---|
| 2,098,717 | 11/1937 | Calkins et al. | 52/588 |
| 2,565,610 | 8/1951 | Kinghorn | 52/522 |
| 3,131,794 | 5/1964 | Bender | 52/588 |
| 3,594,028 | 7/1971 | Scott | 52/522 X |
| 3,866,376 | 2/1975 | Nelsson | 52/588 X |
| 4,091,588 | 5/1978 | Heirich | 52/478 |
| 4,109,437 | 8/1978 | Player et al. | 52/536 |
| 4,155,206 | 5/1979 | Player | 52/522 |
| 4,266,385 | 5/1981 | Oehlert | 52/521 |

FOREIGN PATENT DOCUMENTS

| | | | |
|---|---|---|---|
| 54537 | 11/1976 | Australia | 52/588 |

*Primary Examiner*—Alfred C. Perham

*Attorney, Agent, or Firm*—Hubbard, Thurman, Turner & Tucker

[57] ABSTRACT

An interlocking building panel is provided having an intermediate portion and first and second interlocking portions at respective sides thereof which are adapted for interlocking engagement with interlocking portions of adjacent panels. The first interlocking portion is formed to define a first side wall having a lower and an upper segment intersecting at an obtuse, inwardly included angle and also formed to define a first lip extending inwardly from the upper segment. The second interlocking portion is formed to define a second upwardly extending side wall, an outwardly extending upper wall, a leg depending from said upper wall, and a second lip extending inwardly from the leg. In two embodiments, the upper wall also extends outwardly from the depending leg to define a fastening surface, while in a third embodiment, the depending leg is spaced outwardly from the second side wall sufficiently to provide a fastening surface in the upper wall between them.

6 Claims, 5 Drawing Figures

INTERLOCKING BUILDING PANEL

BACKGROUND OF THE INVENTION

The present invention relates generally to a building panel structure such as is typically composed of metal or plastic sheet material and, more particularly, the invention relates to an interlocking building panel structure which may be used in conjunction with supporting building framework for either roof or wall construction and which panel is interlocked with adjacent interlocking building panels during assembly of the panels to the supporting framework.

One type of building panel intended for roofing is designed to be installed to the underside of a supporting framework from below the framework. The design of the interlocking edge portions of the panel is therefore limited. Installation of such panels should not require access to the opposite side of the panels, rotation of the panels into engagement with adjoining panels, or the telescoping of panel edges together. Additionally, it is desired that the interlocking edges of the panels be weathertight when installed, preferably without requiring the use of sealing materials. It is also necessary that the panels have sufficient strength when assembled and loaded, as by wind, water or snow, to avoid uneveness or sagging even though the panels may be attached to the supporting framework at relatively widely spaced points. It can be seen that a panel meeting these requirements for use as a horizontal roofing panel would also be suitable for vertical use as siding where the requirements may be less strict.

Interlocking building panels for roofing uses are known in the prior art. For example, U.S. Pat. No. 4,091,588 to Heirich discloses a spring action panel interlock in which a first lip of a first panel is held in engagement with a second lip of a second panel by the wedging action of a downwardly depending leg of the first panel. A downward load on the first panel causes the leg to wedge itself more horizontally and to spread the second lip away from a side wall of the second panel. This spreading is resisted by springiness of the second panel, thereby retaining the panels in engagement.

U.S. Pat. No. 4,109,437 to Player, et al discloses a similar interlocking building panel which adds an additional lip at the uppermost edge of the downwardly depending leg of the first panel disclosed in the Heirich patent. A cooperative groove atop the side wall of the second panel edges this additional lip. The additional lip and groove provide the main load carrying connection between the panels and the wedging action of Heirich serves to maintain the engagement of the lip and groove.

The interlocking building panel of the present invention does not rely on the wedging action of a downwardly depending leg supporting a first lip. Neither does it have the additional lip and cooperating groove arrangement of the Player patent. Instead, a first lip of the present invention is maintained engaged with a second lip of an adjacent panel by the springing action of a first upwardly projecting side wall having an obtuse, inwardly included angle.

Therefore it is an object of the present invention to provide an interlocking building panel which may be installed beneath supporting structure by installers having access to only one side of the panel.

It is a further object of this invention to provide an interlocking building panel which when installed is weathertight.

It is a further object of the invention to provide an interlocking building panel requiring a minimum of material for the interlocking portions thereof.

SUMMARY OF THE INVENTION

An interlocking building panel is provided having an intermediate portion and first and second interlocking portions at respective sides thereof which are adapted for interlocking engagement with interlocking portions of adjacent panels. The first interlocking portion is formed to define a first side wall having a lower and an upper segment intersecting at an obtuse, inwardly included angle and also formed to define a first lip extending inwardly from the upper segment. The second interlocking portion is formed to define a second upwardly extending side wall, an outwardly extending upper wall, a leg depending from said upper wall, and a second lip extending inwardly from the leg. In two embodiments, the upper wall also extends outwardly from the depending leg to define a fastening surface, while in a third embodiment, the depending leg is spaced outwardly from the second side wall sufficiently to provide a fastening surface in the upper wall between them.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
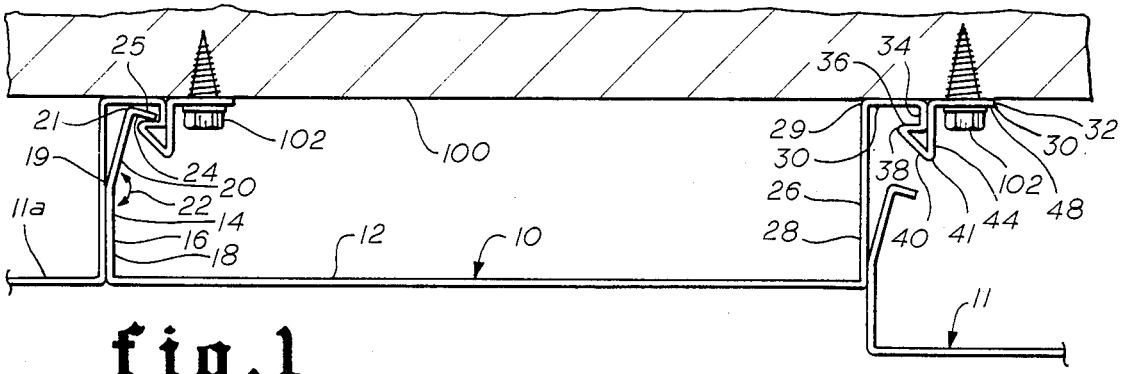
FIG. 1 is an end view of a preferred embodiment of the panel of the present invention, showing the panel installed interlocked with a second panel and showing the position of a third panel just before being urged upwardly into engagement with the panel.

Referring now to the drawings and first to FIG. 1, a preferred embodiment of an interlocking building panel 10 is shown. The panel 10 includes an intermediate portion 12 which may be generally planar as shown or which may adopt other shapes or textures for aesthetic or structural considerations. Integral first and second interlocking portions 14 and 26 are located along opposed sides of said intermediate portion 12 in parallel relationship to each other. Said first and second interlocking portions are adapted for interlocking engagement with substantially identical second and first interlocking portions, respectively, of adjacent building panels such as panels 11 and 11*a* shown in FIG. 1.

Although the various embodiments of the building panel of this invention may be used for either roofing or siding purposes in many orientations, the panel will be described as though it were installed as a roofing panel below supporting structure 100 as shown in FIG. 1 for the preferred building panel 10. Thus the vertical terms upper or upwardly and their synonyms mean toward the supporting structure 100 and the terms lower or downwardly and their synonyms mean away from the supporting structure 100. Likewise, the horizontal terms inner and inwardly and their synonyms mean toward the intermediate portion 12 of the particular panel being described and the terms outer or outwardly and their synonyms mean away from the intermediate portion 12. The term left refers to the first side wall 16 side of the panel and the term right refers to the second side wall 26 side of the panel. These terms are adopted for convenience and clarity of this detailed description only and are not intended to restrict the invention to a roofing panel or to any particular orientation.

The first interlocking portion 14 of the panel 10 includes an integral first side wall 16 which projects upwardly from the intermediate portion 12. The first side wall 16 includes a substantially planar lower segment adjacent and perpendicular to the intermediate portion 12 and a substantially planar upper segment 20 which extends upwardly and inwardly from the lower segment 18. The intersection between the lower segment 18 and upper segment 20 defines an inwardly included obtuse angle 22. An obtuse angle is an angle greater than 90° and less than 180°. In this embodiment, it is preferred that the angle 22 be greater than 160°. A first lip 24 projects inwardly and downwardly from an upper edge 21 of the upper segment 20.

The shape of the first interlocking portion 14 is such that the application of a force having an outward component to the upper surface 25 of the first lip 24 will cause the first lip 24 to move outwardly.

The second interlocking portion 26 of the interlocking building panel 10 includes a substantially planar second side wall 28 projecting upwardly from and substantially perpendicular to the intermediate portion 12. The panel has been bent at an upper edge 29 of the second side wall 28 to form a first upper wall portion 46 extending outwardly from the upper edge 29 to a first leg 34. The first leg 34 depends downwardly from the first upper wall portion 46 to an inwardly projecting second lip 36. Said second lip 36 extends inwardly substantially parallel to and spaced below said first upper wall portion 46. A ramp 40 depends downwardly and outwardly from an inner edge 38 of said second lip 36. A second leg 44 extends upwardly from a lower edge 41 of the ramp 40. At a point adjacent the outer edge 47 of the first upper wall portion 46, the panel has been bent outwardly to form an outwardly extending second upper wall portion 48. The first upper wall portion 46 and the second upper wall portion 48, although not continuous, together form an upper wall 30. The second upper wall portion 48 is wide enough to permit the panel to be fastened to adjacent supporting structure 100 as by a fastener 102 extending through the second upper wall portion 48. The second upper wall portion 48 may be adapted for insertion of fasteners as by prepunched holes or dimples.

As can be seen in FIG. 1, the interlocking building panel 10 described may be formed by the repeated bending of a single sheet of metal or plastic. Said first interlocking portion 14 may be formed by a succession of bends at one edge of the intermediate panel portion 12, thereby forming the lower segment 18, the upper segment 20, and the first lip 24, respectively. Similarly, the second interlocking portion 26 may be formed by a succession of bends at the opposite edge of the intermediate portion 12. These bends form the second side wall 28, the first upper wall portion 46, the first leg 34, the second lip 36, the ramp 40, the second leg 44, and the second upper wall portion 48, respectively.

Figure 4:
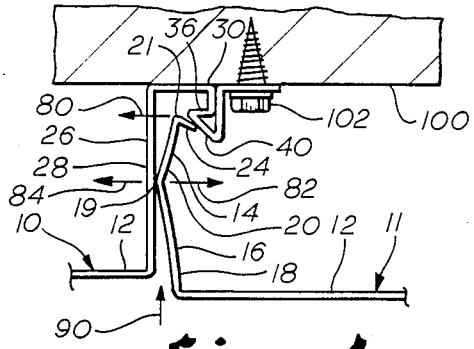
FIG. 4 shows a panel of the preferred embodiment of FIG. 1 being urged upwardly into engagement with another panel of the preferred embodiment.

As can be seen from FIG. 4, both the second interlocking portion 26 of the panel 10 and the first interlocking portion 14 of a similar panel 11 deform when the panel 11 is urged into engagement with the panel 10 by a force represented by an arrow 90. The panels 10 and 11 first engage each other at two points; the first lip of the panel 11 slides upwardly along the ramp 40 of the panel 10 and the lower edge 19 of the upper side wall segment of the panel 11 presses against the second side wall 28 of the panel 10. The first interlocking portion 14 is deformed by an outwardly directed force applied to the first lip 24, which causes the upper edge 21 of the upper segment 20 to move outwardly as shown by the arrow 80. Similarly, an inwardly directed force is applied to the lower edge 19 of the upper segment 20 of the first interlocking portion, causing it to move inwardly as shown by the arrow 82. To accommodate these two forces, both the lower segment 18 and the upper segment 20 of the first side wall 16 are deformed from their unstressed, substantially planar shape as shown in FIG. 1 to the curved shapes shown in FIG. 4. In a like fashion, an inwardly directed force is applied to the sidewall 28 of the second interlocking portion 26 of the panel 10, which causes that side wall to bend inwardly as shown by the arrow 84 and adopt the curved shape shown in FIG. 4. The distortion of the first interlocking portion 14 and second interlocking portion 26 as shown in FIG. 4 permits the first interlocking portion 14 to move upwardly until the first lip 24 passes the inner edge 38 of the second lip 36 and is able to move into the space above the second lip 36. This permits the first interlocking portion 14 and second interlocking portion 26 to return to their original shape as shown in FIG. 1 and the panels are interlocked. A downward load on panel 11 will then be supported by the engagement of the first lip 24 with the second lip 36 of the panel 10.

The preferred embodiment shown in FIG. 1 has the additional advantage of being weathertight when installed as shown in FIG. 1, since any water passing through the fastener hole in the upper wall 30 cannot leak into the interlocking portions of the engaged panels.

Figure 2:
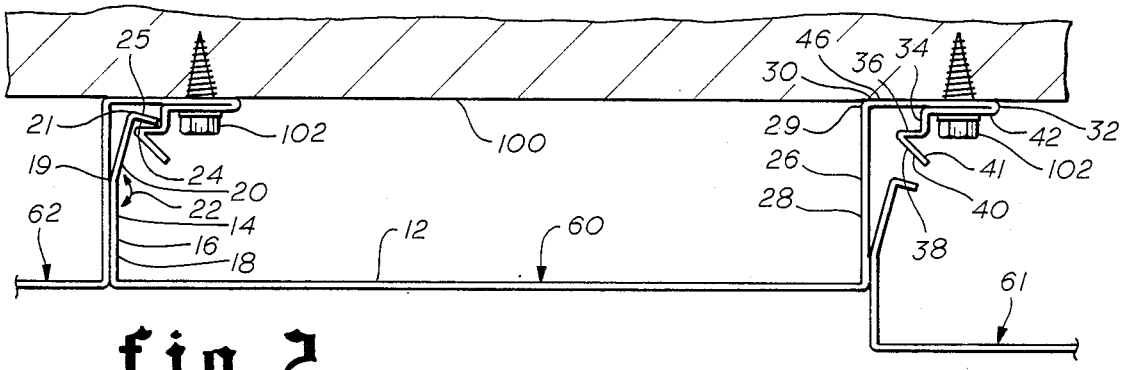
FIG. 2 shows a second embodiment of the panel of the present invention installed similarly to the panel of FIG. 1.

Looking next to the embodiment shown in FIG. 2, it can be seen that this panel 60 differs from the panel 10 of FIG. 1 only in the upper wall 30 and second lip 36 of the second interlocking portion 26. The second lip 30 extends continuously from the upper edge 29 of the second sidewall 28 to an outer edge 32. At the outer edge 32, the upper wall 30 is folded back upon itself to form a double thickness portion 42 of the upper wall 30 between the outer edge 32 and the first leg 34. The first leg 34, the first lip 36, and the ramp 40 all depend from the upper wall 30 in the same manner as in the preferred embodiment of FIG. 1. However, the second interlocking portion 26 of this embodiment ends at the lower edge 41 of the ramp 40. This panel 60 does not include the second leg 44 of the preferred panel 10.

The double thickness portion 42 of the upper wall 30 provides the fastening surface required to attach this interlocking building panel 60 to supporting structure 100 as by a fastener 102. Prepunched holes or preformed dimples may be provided for easier insertion of fasteners 102. However, this embodiment does not share the weathertight interconnection of the preferred embodiment, as rain water may seep into the connection through the fastener hole between the two walls of the double thickness portion. To minimize this problem, a sealer may be applied to the panel in this area, preferably at the time of manufacture.

As can be observed from FIGS. 1 and 2, the geometry of the interlocking portions of the panel 60 is identical to that of the panel 10. Therefore, the operation of the interlocking portions of the panel 60 is the same as the operation of the panel 10 previously described. Interlocking panels 10 and 60 may be interchanged in use and either type may be interlocked with an adjoining panel of the other type.

Figure 3:
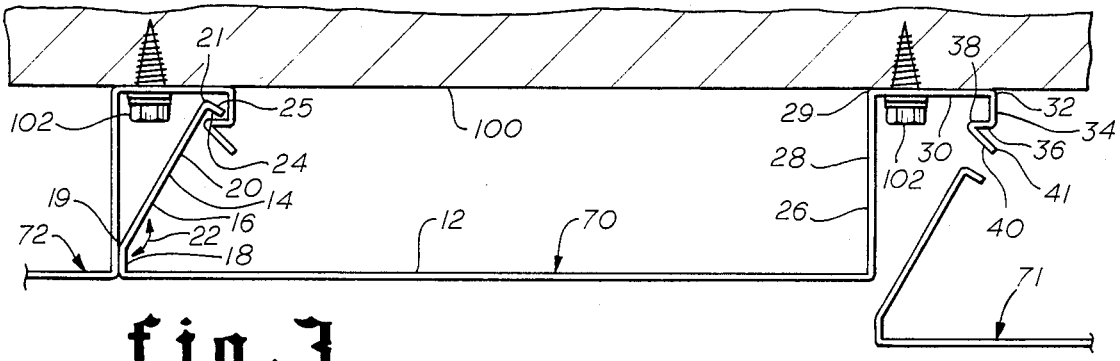
FIG. 3 shows a third embodiment of the panel of the present invention installed similarly to the panel of FIG. 1.

Looking next to FIG. 3, an interlocking building panel 70 of a third embodiment of this invention is disclosed. This panel 70 differs from the panels 10 and 60 of FIGS. 1 and 2, respectively, in that the fastening surface of the second interlocking portion 26 is located between the second side wall 28 and the first leg 34, instead of outwardly of the first leg 34. This requires that the second lip 36 and the inner edge 38 thereof be spaced farther from the second side wall 28 to provide access for the installation of the fasteners 102.

Like the panels 10 and 60, the panel 70 of FIG. 3 has an intermediate portion 12 with a first interlocking portion 14 and a second interlocking portion 26 on opposite sides thereof. The first interlocking portion 14 again has a first side wall 16 divided into a lower segment 18 and an upper segment 20. However, the upwardly projecting lower segment 18 is shorter than that of the preferred embodiment and the inwardly included obtuse angle 22 between the lower and upper segments 18 and 20 is smaller than that of the preferred embodiment, characteristically being less than 160°. This more inwardly upward projection of the upper segment 20 combined with the greater height of the upper segment 20 result in the upper edge 21 being located significantly farther inward than the upper edge 21 of the preferred embodiment. In both embodiments, the first lip 24 projects inwardly and downwardly from the upper edge 21.

Likewise, the second interlocking portion 26 of the panel 70 includes an upwardly projecting second side wall 28 surmounted by an outwardly projecting upper wall 30. However the upper wall 30 extends only to the depending first leg 34 and does not continue outwardly of the first leg 34. As stated above, the first leg 34 itself is spaced signficantly farther from the second side wall 28 than the first legs 34 of the panels 10 and 60, providing a wider upper wall 30 between them so that a fastener 102 may be inserted therethrough. Again, prepunched holes 50 or dimples may be provided in the upper wall 30 for easier insertion of the fastener 102. Because the prepunched holes of this embodiment will permit rain water to enter the interconnection, it is preferred that sealing washers be used with the fasteners 102.

The first leg 34, second lip 36, and ramp 40 are constructed substantially the same as those of the panel 60 of the second embodiment. Again, the panel terminates at the lower edge 41 of the ramp 40 and no second leg 44 is provided.

Figure 5:
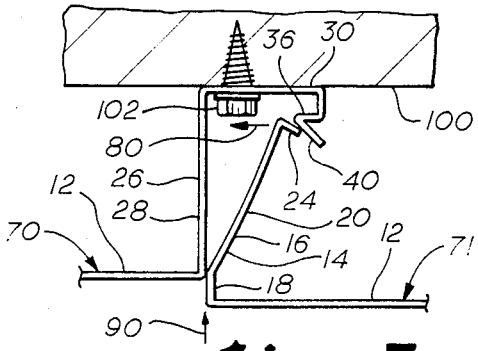
FIG. 5 show a panel of the third embodiment of FIG. 3 being urged upwardly into engagement with another panel of the third embodiment.

During installation, as shown in FIG. 5, the panel 70 of this third embodiment operates similarly to the panels 10 and 60 of the preferred and second embodiments. As before, the lower edge 19 of the upper segment 20 is the point of contact between the first side wall 16 and the second side wall 28. Because this lower edge 19 is lower in this embodiment, the point of contact between the two side wall 16 and 28 is also lower and closer to the intermediate panels 12 which provide horizontal bracing. Therefore, the lower segment 18 and the second side wall 28 of this embodiment deform less than those of the first embodiment shown in FIG. 4.

In contrast, the significantly greater unbraced length of the upper segment 20 of this embodiment causes an increased deformation of the upper segment 20, as shown in FIG. 5. Once the first lip 24 has passed beyond the second lip 38, the first lip 24 springs into the space between the second lip 38 and the upper wall 30, engaging the adjacent panels and supporting the panel 71. The contact of the lower edge 19 of the upper segment with the second wall 28 maintains the engagement of the first lip 24 with the second lip 38 and the panel 71 is installed.

Thus it is apparent that there has been provided, in accordance with the invention, an interlocking building panel that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly it is intended to embrace all such alternatives, modifications and variations as fall within the spirit and broad scope of the appended claims.

What is claimed is:

1. An interlocking building panel comprising:

(a) an intermediate portion; and (b) first and second interlocking portions at respective sides of said intermediate portion with each interlocking portion being adapted for interlocking engagement with an interlocking portion of an adjacent panel;

(c) said first interlocking portion being formed to define:

(1) a first side wall which includes:

(i) a lower segment extending upwardly from said intermediate portion;

(ii) an upper segment extending upwardly and inwardly from said lower segment at an obtuse, inwardly included angle; and (2) a first lip extending inwardly from said upper segment; and (d) said second interlocking portion being formed to define;

(i) a second side wall extending upwardly from said intermediate portion;

(ii) an upper wall extending outwardly from said second side wall in offset relation to said intermediate portion, said upper wall being adapted for fastening to adjacent supporting structure;

(iii) a leg depending from said upper wall; and (iv) a second lip extending inwardly from said leg, with an inner edge of said second lip being sufficiently spaced apart from said second side wall to permit a first lip of an adjacent interlocking panel to pass upwardly between said second side wall and said inner edge of said second lip.

2. The interlocking building panel of claim 1 wherein said first lip extends downwardly and inwardly from an upper edge of said upper segment of said first side wall.

3. The interlocking building panel of claim 1 wherein said second interlocking portion is further formed to define a ramp portion extending downwardly and outwardly from said inner edge of said second lip so as to urge the first lip of an adjacent panel toward said second side wall as the adjacent panel is forced upwardly into engagement with said second interlocking portion.

4. The interlocking building panel of claim 3:

wherein said upper wall has an outer edge; and wherein said leg depends from said upper wall intermediate said second side wall and said outer edge.

5. The interlocking building panel of claim 4:

wherein said upper wall extends continuously from said second side wall to said outer edge; and wherein said upper wall is folded back upon itself at said outer edge to form an upper wall of double thickness between said outer edge and said leg.

6. The interlocking building panel of claim 4:

wherein said leg comprises a first leg;

wherein said second interlocking portion is further formed to define a second leg extending upwardly from a lower edge of said ramp portion to said outer wall; and wherein said upper wall includes a first upper wall portion between said side wall and said first leg and a second upper wall portion between said second leg and said outer edge.

* * * * *